US005368300A

United States Patent [19]

Becker

[11] Patent Number: 5,368,300

[45] Date of Patent: Nov. 29, 1994

[54] GOAL-SCORING GAME

[75] Inventor: James R. Becker, New York, N.Y.

[73] Assignee: Anjar Co., New York, N.Y.

[21] Appl. No.: 152,728

[22] Filed: Nov. 15, 1993

[51] Int. Cl.[5] ..... A63F 7/02

[52] U.S. Cl. ..... 273/121 R; 273/119 R

[58] Field of Search ..... 273/108, 118 R, 118 A, 273/119, 120, 121

[56] References Cited

U.S. PATENT DOCUMENTS

| | | | |
|---|---|---|---|
| 465,739 | 12/1891 | Guericke . | |
| 1,567,251 | 12/1925 | Ekstein . | |
| 2,164,361 | 7/1939 | Swenson . | |
| 3,643,954 | 2/1972 | Meyer et al. . | |
| 3,643,955 | 2/1972 | Breslow . | |
| 3,645,530 | 2/1972 | Hernandez et al. . | |
| 4,037,840 | 7/1977 | Goldfarb et al. . | |
| 4,046,380 | 9/1977 | Goldfarb et al. | 273/119 R |
| 4,061,334 | 12/1977 | Kanno . | |
| 4,274,630 | 6/1981 | Kulesza et al. . | |
| 4,998,729 | 3/1991 | Lischerelli | 273/118 R X |

OTHER PUBLICATIONS

"Flip Shot Pinball" Marx Catalog Advertisement, 1977, p. 28.

*Primary Examiner*—Vincent Millin
*Assistant Examiner*—Raleigh W. Chiu
*Attorney, Agent, or Firm*—Amster, Rothstein & Ebenstein

[57] ABSTRACT

A goal-scoring game is played on a convex playing field having an apex, a periphery lower than the apex, and a spaced apart plurality of goals adjacent the periphery for receipt of game pieces. A plurality of movable game pieces are provided for movement about the field and into the goals. Player-operated impacting flippers are disposed adjacent to and associated with each of the goals, for impacting one of the game pieces to drive the impacted game piece away from the associated goal. A disperser is disposed over the field for storing a plurality of the game pieces and dropping them one at a time in rapid succession precisely onto the apex of the field.

23 Claims, 5 Drawing Sheets

GOAL-SCORING GAME

BACKGROUND OF THE INVENTION

The present invention relates to a game, and more particularly to a game wherein each player attempts to score goals by driving game pieces into the goal of an opponent.

There exist many different goal-scoring games, but typically these games have a playing field defining a spaced-apart plurality of goals adjacent the periphery thereof for receipt of game pieces. A plurality of movable game pieces are provided for movement about the field and into the goals. Each player is provided with player-operated impacting means, frequently disposed adjacent to and associated with each of the goals, for impacting one of the game pieces to drive the impacted game piece away from the associated goal (and hopefully towards the opponent's goal). Typically only one game piece is on the playing field at a given time, thus limiting the play value of the game. Indeed, in order to "speed up" the game, attempts have been made to speed up the movement of the game pieces about the field (for example, as in air hockey where an air cushion reduces the friction between the game pieces and the playing field, thereby to increase puck speed).

However, even these improvements fail to retain the interest of children raised on video arcade games where the player is attempting to "shoot down," "capture," "knock out" or the like a multitude of characters or vehicles rapidly approaching the player with hostile intent. Indeed, there may be tens to hundreds of these hostile pieces closing in on the player at a given instant. Accordingly, to a video game graduate, the play value of a game is minimal where there is but a single game piece in movement at a time.

Conventional pinball machines have typically permitted a number of balls to be on the playing field and "in play" at a given time if the player so elected by initially shooting two balls simultaneously or in rapid succession, with the second ball entering the playing field before the first ball left it. Typically no more than two balls are in play at any given time and, as the pinball machine has only five balls, a maximum of five balls may be in play at a given time. Some games have attempted to provide multiple game pieces by allowing each player to introduce into play a separate game piece, but the number of game pieces in play simultaneously was then limited by the number of players. Even were the players able to each introduce into play a plurality of game pieces during play of the game, the number of game pieces in play at a given time would not greatly exceed the number of players since the players, occupied with defending their goals and attempting to score goals against their opponents, have little time to expend on bringing new game pieces into play.

In order to ensure fairness, each game piece should be introduced into play in a manner which does not favor any one player over another, and with no player having control over the dispensing process.

Accordingly, it is an object of the present invention to provide a goal-scoring game including means for storing a plurality of game pieces and introducing them into play one at a time in rapid succession so that there is typically a large number of game pieces in play at any given time.

Another object is to provide such a game wherein the number of game pieces in play at any given time typically exceeds the number of players.

A further object is to provide such a game having a high play value with game pieces being introduced into play at a rate of about one per second.

It is another object to provide such a game wherein the game pieces are put into play impartially and without player control of the process.

It is also an object of the present invention to provide such a game which is simple and easy to manufacture, maintain and play.

SUMMARY OF THE INVENTION

It has now been found that the above and related objects of the present invention are obtained in a goal-scoring game played on a convex playing field having an apex, a periphery lower than the apex, and a spaced apart plurality of goals adjacent the periphery for receipt of game pieces. A plurality of movable game pieces are provided for movement about the field and into the goals. Player-operated impacting means are disposed adjacent to and associated with each of the goals, for impacting one of the game pieces to drive the impacted game piece away from the associated goal. A dispenser means is disposed over the field for storing a plurality of the game pieces and dropping them one at a time in rapid succession precisely onto the apex of the field.

In a preferred embodiment, the periphery of the field defines, intermediate each adjacent pair of the goals, a raised segment which is inwardly bowed such that a game piece driven against the segment will gravitate towards one of the adjacent pair of goals. The game pieces are rollable and preferably spherical in configuration. The impacting means is a pair of player-operated flippers and may also be used to drive the impacted game piece towards another of the goals. The dispenser means is disposed over the center of the field and drops the game pieces without the game pieces having any appreciable lateral (i.e., radial) momentum, preferably at a rate of about one per second.

Preferably the dispenser means defines a stationary reservoir for storing a plurality of the game pieces, a rotatable impeller having a plurality of vanes for isolating intermediate an adjacent pair of the vanes a single one of the plurality of game pieces from the remainder thereof in the reservoir, and means for rotating the impeller. A stationary sub-chamber has, over the apex of the field, an aperture for passage of a single game piece therethrough at a time. Means separating the impeller and the sub-chamber permit a game piece to drop from the impeller into the sub-chamber and hence pass, under the influence of gravity, through the sub-chamber aperture and onto the field.

In a preferred embodiment of the dispenser means, the sub-chamber has an inwardly curving sidewall, the aperture being at the bottom of the sub-chamber, and the separating means permits a predetermined maximum number of game pieces to drop simultaneously from the impeller onto the sidewall of the sub-chamber. Means also separate the reservoir and the impeller while permitting a predetermined maximum number of game pieces to pass simultaneously from the reservoir to the impeller. In a variant of the dispensing means, at least one of the separating means is under player control for adjusting the rate at which the dispensing means drops the game pieces.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
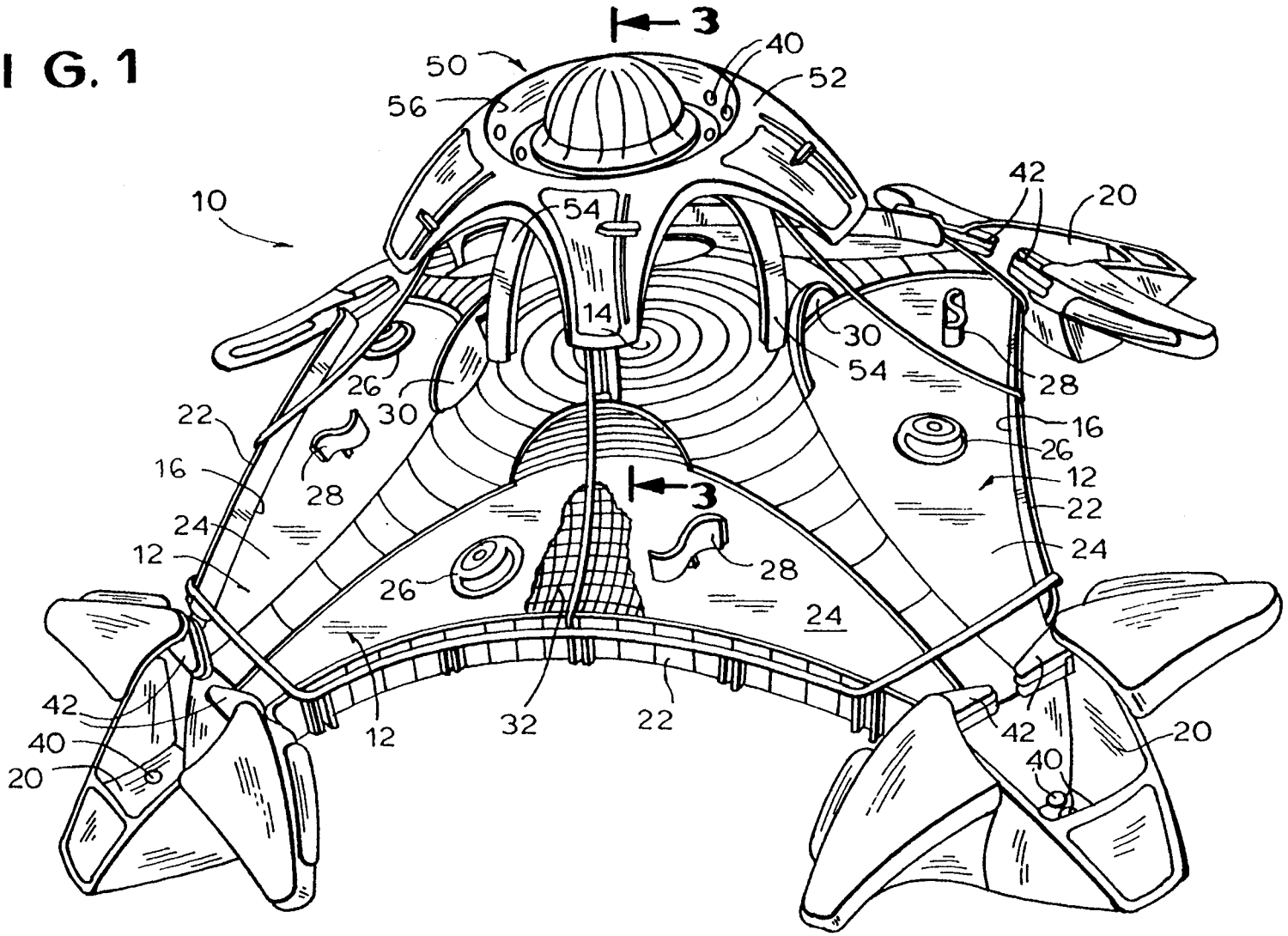
FIG. 1 is an isometric view of a first embodiment of a game according to the present invention.

Referring now to the drawing, and in particular to FIG. 1 thereof, therein illustrated is a goal-scoring game according to the present invention, generally designated by the reference numeral 10. The game 10 is played on a convex playing field, generally designated 12, having an apex 14, a periphery 16 lower than the apex 14, and a spaced-apart plurality of goals 20 adjacent the periphery 16 for receipt of game pieces. Thus, for a game intended to be played by four players, there will be four goals equidistantly spaced apart along the periphery 16. Intermediate each adjacent pair of the goals 20, the periphery 16 defines a raised rim 22 which is inwardly arcuately bowed such that a game piece driven against the rim 22 will gravitate along the rim 18 on the field upper surface 24 towards one of the adjacent pair of goals 20. The degree of curvature of the upper surface 24 of field 12 will determine the rate at which a game piece newly put in play will directly approach one of the goals 20.

The upper surface 24 of the playing field 12 may include a variety of passive interposing members in the form of bells 26, spinners 28, and rebound surfaces 30 to enhance the play value of the game by introducing sounds (when a bell 26 is hit by a game piece), unpredictable re-directions of the moving game piece (when a game piece engages a spinner 28 and is re-directed thereby), and banking shots (when a game piece is "banked" off a rebound surface 30). A game piece-restraining net 32 is removably disposed over the playing field 12 during play of the game 10 to prevent any of the players becoming injured by a game piece flying off the field 12. Alternatively, a transparent cover may be disposed over the playing field 12 for the same purpose.

A plurality of movable game pieces 40 are provided for movement about the field 12 and into the goals 20. The game pieces 40 are preferably rollable—e.g., of cylindrical configuration. Marble or marble-like game pieces of spherical configuration are especially preferred.

Preferably, player-operated impacting means 42 are disposed adjacent to and associated with each of the goals 20 for impacting one of the game pieces 40 approaching the goal to drive the impacted game piece 40 away from the associated goal 20. Preferably the impacting means is a pair of player-operated flippers, similar to those found on pinball machines, one flipper to either side of the goal 20. Both flippers associated with a given goal may be operable together as a unit; alternatively, each of the two flippers associated with a particular goal may be independently operable. The flippers are used both for defensive purposes—that is, to drive game pieces 40 away from the associated goal 20—and for offensive purposes—that is, to drive game pieces 40 towards an opponent's goal 20.

A critical feature of the present invention is the dispenser, generally designated 50, disposed over the field 12 for storing a plurality of the game pieces 40 and dropping them one at a time in rapid succession precisely onto the apex 14 of the field 12. To this end, the dispenser 50 is typically disposed over the center of the field, where the lower portion thereof acts as a support for the central portion of the net 32. Critical features of the dispensing means 50 include its ability to drop game pieces 40 onto the field apex 14 without the game pieces 40 having any appreciable lateral (i.e., radial) momentum, and its ability to do so at the relatively high rate of about one game piece per second.

If the dispenser 50 discharged the game pieces 40 onto the field apex 14 with any lateral momentum, then the game pieces 50 would tend to roll down from the apex 14 in a direction determined by that lateral momentum. Thus one player would predominate as the one who had an initial opportunity to impact with his impacting means 42 a game piece 40 newly placed in play. Whether this constitutes an advantage or a disadvantage, it sill represents a deviation from impartiality in the manner in which a game piece 40 is put into play.

The purpose in having the game pieces 40 newly placed into play at a relatively high rate (preferably about 60 balls per minute) is to give the players the feeling of space-age rapid action while at the same time not overwhelming them. As will become apparent hereinafter, the manufacturer can adjust the rate at which the game pieces are newly put into play so as to make the game suitable for players of different age ranges or physical abilities. Indeed, as will be seen hereinafter, the dispenser 50 may be made adjustable by the players so as to vary the rate at which game pieces 40 are newly put into play.

More particularly, the dispenser 50 comprises a stationary housing 52 which is supported on stationary legs a distance above the apex 14 of the playing field 12, which corresponds to the center of the field 12. The legs 54 are preferably disposed behind the rebound surfaces 30 so that they provide only minimal interference with play of the game. The legs 54 may be received within recesses or apertures in the field upper surface 24 and be removable therefrom for relatively flat packaging of the game 10 or may be permanently secured thereto (for example, by thermal welding).

Figure 2:
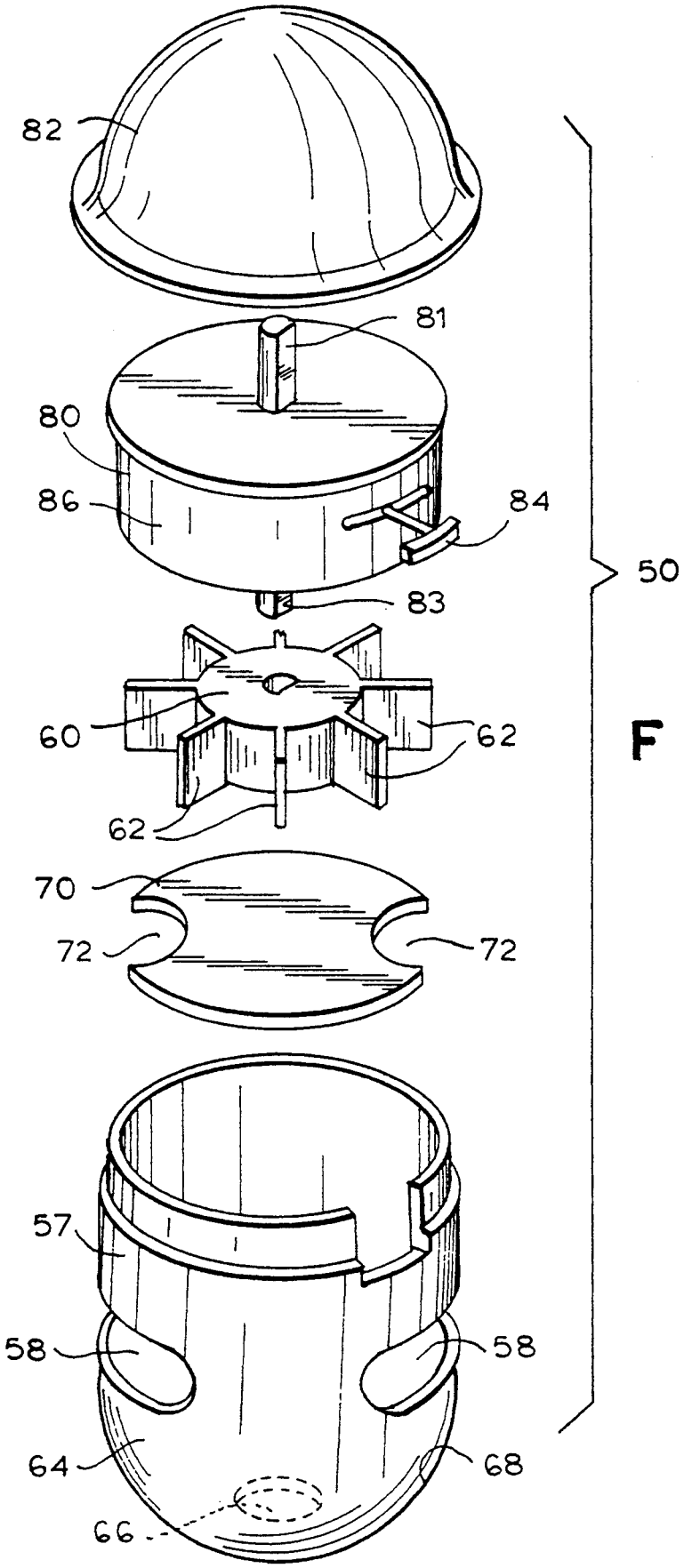
FIG.2 is an exploded isometric view of the dispensing means.
Figure 3:
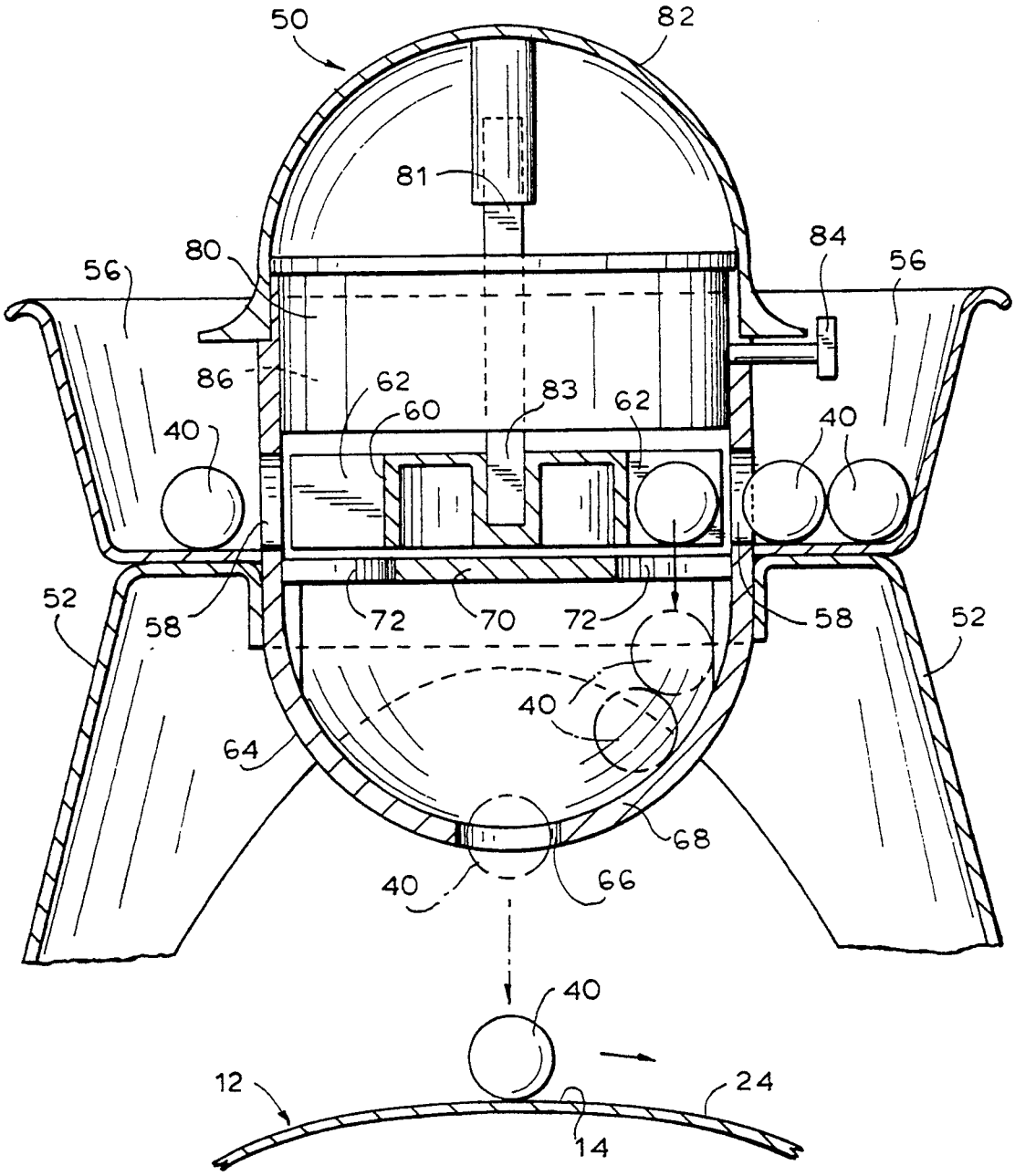
FIG. 3 is a sectional view of the dispensing means taken along the line 3—3 of FIG. 1.

The housing 52 defines a stationary reservoir 56 (see FIG. 3) for storing a plurality of the game pieces 406 preferably as many as 60 game pieces so that a game can continue for a minute when the game pieces are being newly put into play at a rate of one per second. Referring now to FIGS. 2–3, a cylindrical sub-housing 57 is disposed in and above the reservoir 56, the sub-housing 57 defining at least one aperture 58 (two apertures 58 being illustrated) permitting game pieces 40 from the reservoir 56 to enter into the interior of the sub-housing 57. Within the sub-housing 57, an impeller 60 is rotatably disposed, the impeller 60 having a plurality of vanes 62 (eight vanes 62 being illustrated) extending radially from the axis of rotation for isolating intermediate an adjacent pair of the vanes 62 a single one of the plurality of game pieces 40 from the remainder thereof in the reservoir 56. The impeller 60 is disposed slightly below the lowest portion of the reservoir 56 so that there is a gravity feed of the game pieces 40 from the reservoir 56 through the apertures 58 into the impeller 60.

A stationary sub-chamber 64 is secured to the housing 52 and defines, precisely over the apex 14 of the field 12, an aperture 66 for passage of a single game piece 40 therethrough at a time. Preferably sub-chamber 54 has an inwardly curving sidewall 68, with the aperture 66 being disposed at the bottom of the sub-chamber 64 and fed with game pieces which have rolled down the curved sidewall 68. A plate 70 separates the bottom of the impeller 60 from the top of the sub-chamber 64 and permits a game piece 40 to drop from the impeller into the sub-chamber and hence pass, under the influence of gravity, through the sub-chamber aperture 66 and onto the field apex 14. Typically the plate defines at least one aperture 72 which permits a single game piece 40 disposed between two adjacent vanes 62 to drop from the impeller 60 onto an upper portion of the curved sidewall 68 of the sub-chamber 64 (two apertures 72 being illustrated). While the game piece is possessed of substantial lateral momentum as it is carried around by the impeller 60, the passage of the game piece, first through the sub-chamber aperture 66 and then through the plate aperture 72, causes the lateral momentum to be shed so that the game piece 40 drops onto the field 12 without any appreciable lateral momentum.

Means 80 is provided for rotating the impeller 60 relative to the housing 52, means 80 preferably being a spring having one end functionally secured to the impeller 60 at 81 for movement therewith (via a gear train) and the other end functionally secured to a rotatable cover 82 for movement therewith at 83. The cover 82 is disposed atop the housing 52 and is formed to facilitate grasping thereof so that it may be rotated relative to the housing 52, thereby to tension the spring 80. A conventional ratcheting mechanism (not shown) limits rotation of the cover 82 to one direction. Before the tensioning process begins, an on/off switch 84 mounted on the exterior of the housing 52 is moved to the "off" position so that it precludes movement of the impeller 60 relative to the housing 52 during the tensioning process. When the tensioning process is completed and the players are ready to commence play of the game, the switch 84 is moved to the "on" position so that it enables rotation of the impeller 60 relative to the housing 52 under the influence of spring 80. A conventional set of gears (illustrated as a black box 86 in FIG. 3) reduces the speed of rotation of the impeller 60.

Various techniques may be used to control the rate at which the game pieces 40 are put into play by the dispenser 50. For example, the rate at which the game pieces feed from the reservoir 56 into the impeller 60 may be controlled by the number of sub-housing apertures 58 and the size thereof. Each sub-housing aperture 58 permits only a fixed number of game pieces 40 to pass therethrough at a time, and thus the number of sub-housing apertures 58 determine the maximum number of game pieces which can be fed from the reservoir 56 into the impeller 60 simultaneously. The size of the sub-housing apertures 58 determines the number of game pieces 40 which will be able to pass through each sub-housing aperture 58 at one time, and thus also the size of the sub-housing apertures 58 determines the maximum number of game pieces which can be fed from the reservoir 56 into the impeller 60. Similarly, the rate at which game pieces feed from the impeller 60 into the sub-chamber 64 may be controlled by the number of plate apertures 72. Each plate aperture 72 permits only a single game piece 40 to pass therethrough at a time, and thus the number of plate apertures 72 determines the maximum number of game pieces which can be fed from the impeller 60 into the sub-chamber 64 simultaneously.

While in the main embodiment illustrated in FIGS. 1–3, the number of sub-housing apertures 58 and plate apertures 72 is fixed at the time and place of manufacture, it is clearly within the skill of those skilled in the mechanical arts to provide a second embodiment 50' of the dispensing means wherein each sub-housing 57 has a plurality of apertures 58, each plate 70 has a plurality of apertures 72 (the apertures 58, 72 being typically equidistantly spaced apart along the respective circumferences), and there is additionally provided means for mechanically varying the number of the apertures 58, 72 (or size of the apertures 58) which are effectively open—i.e., effective during play for the passage of game pieces therethrough. For example, intermediate each pair of sub-housing apertures 58, a door (not shown) may be slidably disposed, the door being slidable between a position exclusively intermediate the apertures 58 and a position covering a respective aperture 58 to close it. Alternatively, a door (not shown) may be pivotably secured above each aperture 58, the door being pivotable between a position exclusively above the aperture 58 and a position (pivoted downwardly) covering the aperture 58 to close it.

Figure 4:
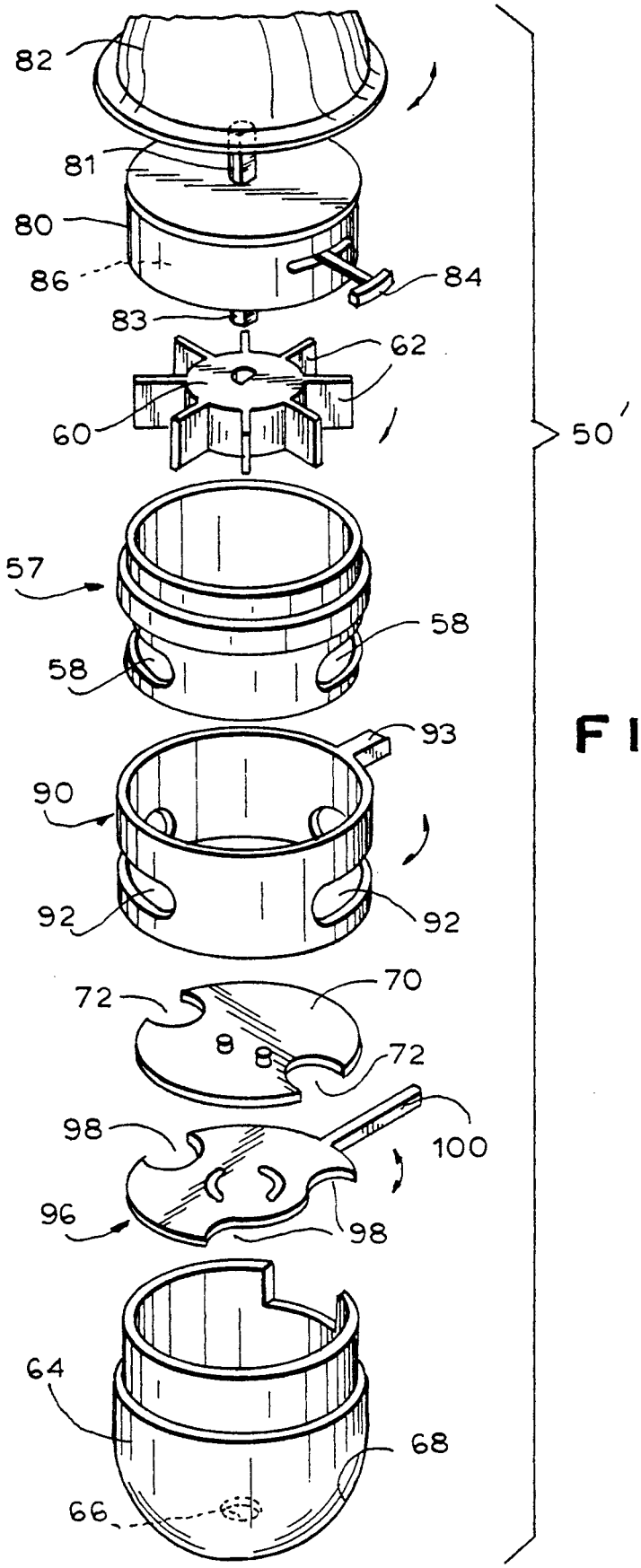
FIG. 4 is an exploded isometric view of a second embodiment of the dispensing means.
Figure 5:
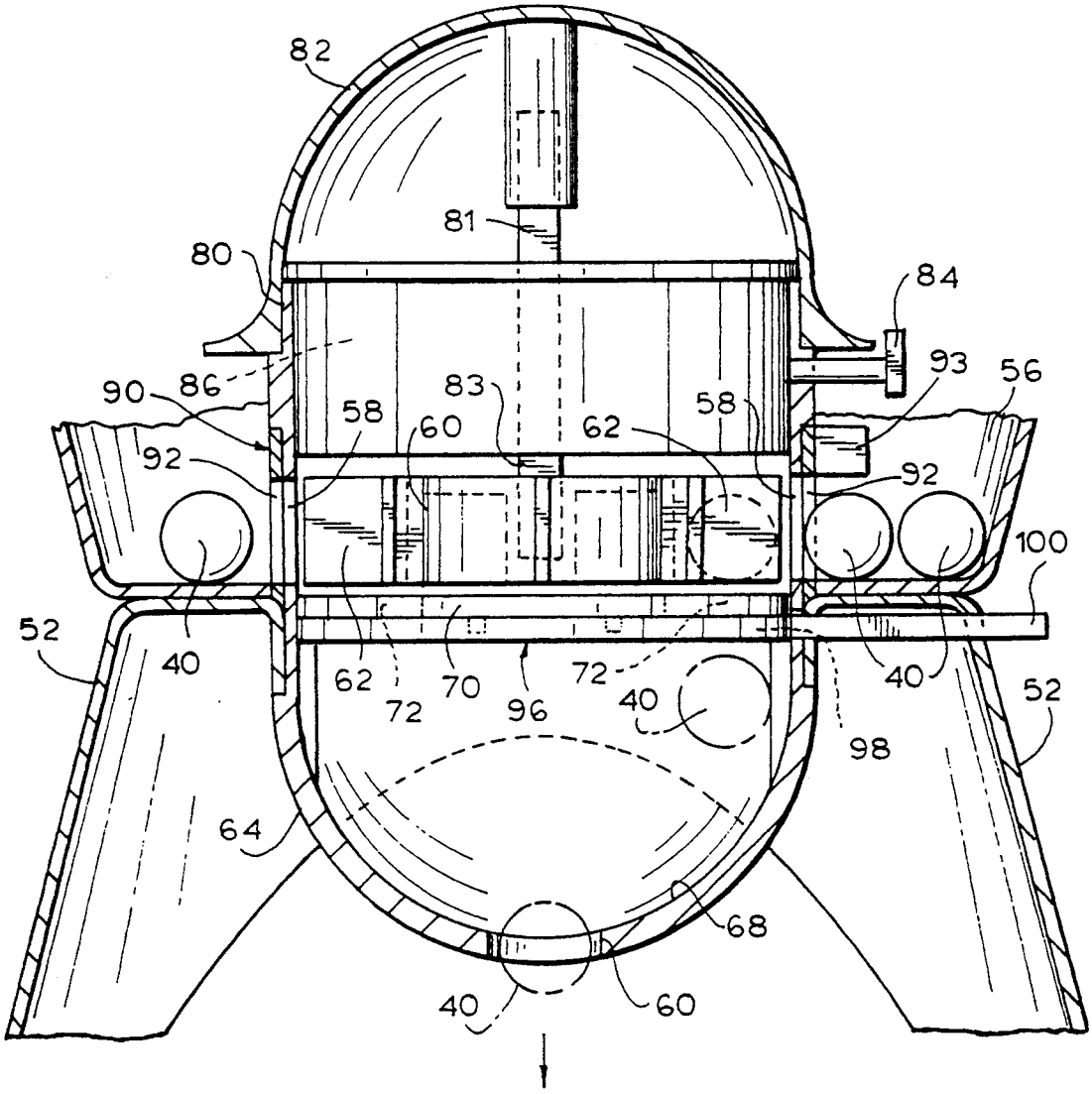
FIG. 5 is a sectional view thereof.

As illustrated in FIGS. 4 and 5, a collar, generally designated 90 and provided with a number of apertures 92 equal to the number of apertures 58, may be rotatably disposed about the sub-housing 57. The collar 90 is rotatable by the players via a dial 93 between a first position wherein its apertures 92 are radially aligned with apertures 58 and do not block any of apertures 58 and a second position wherein its apertures 92 at least partially close some of apertures 58 to vary the effective size and/or number thereof. Alternatively, or in addition thereto, as illustrated in FIG. 4, a rotatable additional partial plate, generally designated 96, is disposed below the plate 72. The additional plate 96 has a plurality of apertures 98 for passage therethrough of game pieces and is rotatable by the players from outside the housing by a dial 100 between a first position wherein the additional plate 96 does not block any of the plate apertures 72 (i.e., its apertures 98 are aligned with plate apertures 72), and a second position wherein the additional plate 96 blocks all but one of the plate apertures 72 (i.e., due to non-alignment of its remaining apertures 98 and plate apertures 72). Preferably movement of the additional plate 96 from the first position to the second position would block or close a progressively increasing number of the plate apertures 72 if there were more than two plate apertures 72. Of course, these are only representative techniques for enabling the players to modify the rate at which game pieces are initially put into play, and various equivalent techniques may also be utilized.

In a preferred embodiment of the present invention, there are two diametrically opposed sub-housing apertures 58 and two diametrically opposed plate apertures 72 (each aperture 72 being sized to permit passage therethrough of only one game piece 40 at a time), the impeller 60 has 8 vanes 62, and the spring 80 drives the impeller at a rate of about 4 rotations per minute. The field 12 has a radius of curvature of about 18 inches and defines four equidistantly-spaced goals 20.

To summarize, the present invention provides a goal-scoring game including means for storing a plurality of game pieces and introducing them into play one at a time in rapid succession so that there is typically a large number of games pieces in play at any given time, typically a greater number of game pieces than the number of players. The game has a high play value as the game pieces are introduced into play at a rate at about one per second impartially and without player control of the process. The game is simple and easy to manufacture, maintain and play.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A goal-scoring game comprising:

(A) a convex playing field having an apex, a periphery lower than said apex, and a spaced apart plurality of goals adjacent said periphery for receipt of game pieces;

(B) a plurality of movable game pieces for movement about said field and into said goals;

(C) player-operated impacting means, disposed adjacent to and associated with each of said goals, for impacting one of said game pieces to drive said impacted game piece away from said associated goal; and (D) dispenser means disposed over said field for storing a plurality of at least 4 of said game pieces and dropping them one at a time in rapid succession precisely onto the apex of said field.

2. The game of claim 1 wherein said periphery of said field defines, intermediate each adjacent pair of said goals, a raised segment which is inwardly bowed such that a game piece driven against said segment will gravitate towards one of said adjacent pair of goals.

3. The game of claim 1 wherein said game pieces are rollable.

4. The game of claim 1 wherein said game pieces are spherical in configuration.

5. The game of claim 1 wherein said impacting means is a pair of player-operated flippers.

6. The game of claim 1 wherein said impacting means also drives said impacted game piece towards another of said goals.

7. The game of claim 1 wherein said dispenser means is disposed over the center of said field.

8. The game of claim 1 wherein said dispenser means drops said game pieces without said game pieces having any appreciable lateral momentum.

9. The game of claim 1 additionally including player-operable means for varying the rate at which said dispenser means drops said game pieces stored therein.

10. The game of claim 1 wherein said dispenser dispenses game pieces at a rate of about one per second.

11. A goal storing game comprising:

(A) a convex playing field having an apex, a periphery lower than said apex, and a spaced apart plurality of goals adjacent said periphery for receipt of game pieces;

(B) a plurality of movable game pieces for movement about said field and into said goals;

(C) player-operated impacting means, disposed adjacent to and associated with each of said goals, for impacting one of said game pieces to drive said impacted game piece away from said associated goal; and (D) dispenser means disposed over said field for storing a plurality of said game pieces and dropping them one at a time in rapid succession substantially onto the apex of said field; defining:

(i) a stationary reservoir for storing a plurality of said game pieces;

(ii) a rotatable impeller having a plurality of vanes for isolating intermediate an adjacent pair of said vanes a single one of said plurality of game pieces from the remainder thereof in said reservoir;

(iii) means for rotating said impeller;

(iv) a stationary sub-chamber having over the apex of said field an aperture for passage of a single game piece therethrough at a time; and (v) means separating said impeller and said sub-chamber while permitting a game piece to drop from said impeller into said sub-chamber and hence pass, under the influence of gravity, through said sub-chamber aperture and onto said field.

12. The game of claim 11 wherein said sub-chamber has an inwardly curving sidewall, said aperture being at the bottom of said sub-chamber.

13. The game of claim 12 wherein said separating means permits a predetermined maximum number of game pieces to drop simultaneously from said impeller onto said sidewall of said sub-chamber.

14. The game of claim 12 including means separating said reservoir and said impeller while permitting a predetermined maximum number of game pieces to pass simultaneously from said reservoir to said impeller.

15. The game of claim 14 wherein at least one of said separating means is under player control for adjusting the rate at which said dispenser means drops said game pieces.

16. A goal-scoring game comprising:

(A) a convex playing field having an apex, a periphery lower than said apex, and a spaced apart plurality of goals adjacent said periphery for receipt of game pieces;

(B) a plurality of spherical game pieces for movement about said field and into said goals, said periphery of said field defining, intermediate each adjacent pair of said goals, a segment which is inwardly bowed such that a game piece driven against said segment will gravitate towards one of said adjacent pair of goals;

(C) player-operated impacting means, disposed adjacent to and associated with each of said goals, for impacting one of said game pieces to drive said impacted game piece away from said associated goal and towards another of said goals, said impacting means being a pair of player-operated flippers; and (D) dispenser means disposed over the center of said field for storing a plurality of at least 4 of said game pieces and dropping them one at a time in rapid succession precisely onto the apex of said field without said game pieces having any appreciable lateral momentum.

17. A goal-scoring game comprising:

(A) a convex playing field having an apex, a periphery lower than said apex, and a spaced apart plurality of goals adjacent said periphery for receipt of game pieces;

(B) a plurality of spherical game pieces for movement about said field and into said goals, said periphery of said field defining, intermediate each adjacent pair of said goals, a segment which is inwardly bowed such that a game piece driven against said segment will gravitate towards one of said adjacent pair of goals;

(C) player-operated impacting means, disposed adjacent to and associated with each of said goals, for impacting one of said game pieces to drive said impacted game piece away from said associated goal and towards another of said goals, said impacting means being a pair or player-operated flippers; and (D) dispenser means disposed over the center of said field for storing a plurality of said game pieces and dropping them one at a time in rapid succession substantially onto the apex of said field without said game pieces having any appreciable lateral momentum, said dispenser means defining:

(i) a stationary reservoir for storing a plurality of said game pieces;

(ii) a rotatable impeller having a plurality of vanes for isolating intermediate an adjacent pair of said vanes a single one of said plurality of game pieces from the remainder thereof in said reservoir;

(iii) means for rotating said impeller;

(iv) a stationary sub-chamber having an inwardly curving sidewall and, at the bottom thereof and over the apex of said field, an aperture for passage of a single game piece therethrough at a time; and (v) means separating said reservoir and said impeller while permitting a predetermined maximum number game pieces to pass simultaneously from said reservoir into said impeller; and (vi) means separating said impeller and said sub-chamber while permitting a predetermined maximum number of game pieces to drop simultaneously from said impeller onto said sub-chamber sidewall and hence passage under the influence of gravity through said sub-chamber aperture and onto said field.

18. The game of claim 17 wherein at least one of said separating means is under player control for adjusting the rate at which said game pieces drop.

19. A game piece dispenser for use with a playing field, comprising:

(i) a stationary reservoir for storing a plurality of game pieces;

(ii) a rotatable impeller having a plurality of vanes for isolating intermediate an adjacent pair of said vanes a single one of the plurality of game pieces from the remainder thereof in said reservoir;

(iii) means for rotating said impeller;

(iv) a stationary sub-chamber having over the apex of a playing field an aperture for passage of a single game piece therethrough at a time; and (v) means separating said impeller and said sub-chamber while permitting a game piece to drop from said impeller into said sub-chamber and hence pass, under the influence of gravity, through said sub-chamber aperture and onto the playing field.

20. The dispenser of claim 19 wherein said sub-chamber has an inwardly curving sidewall, said aperture being at the bottom of said sub-chamber.

21. The dispenser of claim 20 wherein said separating means permits a predetermined maximum number of game pieces to drop simultaneously from said impeller onto said sidewall of said sub-chamber.

22. The dispenser of claim 20 including means separating said reservoir and said impeller while permitting a predetermined maximum number of game pieces to pass simultaneously from said reservoir to said impeller.

23. The dispenser of claim 22 wherein at least one of said separating means is under player control for adjusting the rate at which the game pieces drop.

* * * * *

UNITED STATES PATENT AND TRADEMARK OFFICE

CERTIFICATE OF CORRECTION

PATENT NO. : 5,368,300

DATED : November 29, 1994

INVENTOR(S) : Becker, et al.

It is certified that error appears in the above-indentified patent and that said Letters Patent is hereby corrected as shown below:

On the title page, item [75], add Mark E. Hartelius, Racine, Wisconsin, and Eric Hamilton, Racine, Wisconsin —

Signed and Sealed this

Twelfth Day of May, 1998

*Attest:*

*Attesting Officer*

BRUCE LEHMAN

*Commissioner of Patents and Trademarks*